US005335388A

United States Patent [19]

Salecker

[11] Patent Number: 5,335,388

[45] Date of Patent: Aug. 9, 1994

[54] CUTTER ASSEMBLY FOR CONDUIT CLEANER

[75] Inventor: Roy W. Salecker, Mendota, Ill.

[73] Assignee: Spartan Tool Div. of Pettibone Corp., Mendota, Ill.

[21] Appl. No.: 47,102

[22] Filed: Apr. 13, 1993

[51] Int. Cl.[5] ..... B08B 9/02

[52] U.S. Cl. ..... 15/104.12; 15/104.09; 15/104.31; 403/1

[58] Field of Search ..... 15/104.09, 104.095, 15/104.12, 104.13, 104.14, 104.31, 104.33, 49.1, 180, 104.11; 403/1, 354, 356, 376, 380; 175/107; 299/39, 41

[56] References Cited

U.S. PATENT DOCUMENTS

| | | | |
|---|---|---|---|
| 1,602,405 | 10/1926 | Fuchs | 15/104.12 |
| 1,684,698 | 9/1928 | Freeman | 15/49.1 |
| 1,918,353 | 7/1933 | Utley | 15/104.33 |
| 2,336,293 | 12/1943 | Pletcher | 15/104.12 |
| 3,525,112 | 8/1970 | Masters | 15/104.12 |
| 4,001,911 | 1/1977 | Watson | 15/104.09 |
| 4,766,631 | 8/1988 | Crane et al. | 15/104.12 |

FOREIGN PATENT DOCUMENTS

| | | | |
|---|---|---|---|
| 69294 | 5/1949 | Denmark | 15/104.12 |

*Primary Examiner*—Edward L. Roberts
*Attorney, Agent, or Firm*—Wood, Phillips, VanSanten, Hoffman & Ertel

[57] ABSTRACT

A blade assembly for attachment to a shaft that is rotatable about an axis on a conduit cleaner. The blade assembly has a hub defining an axis to be coaxial with the rotational axis of a shaft to which the blade is mounted. A cutting blade is attached to the hub so that the cutting blade does not project through the hub axis.

19 Claims, 2 Drawing Sheets

CUTTER ASSEMBLY FOR CONDUIT CLEANER

BACKGROUND OF THE INVENTION

1. Field of the Invention

This invention relates to conduit cleaners of the type employing a rotary cutting blade and, more particularly, to a cutting blade assembly for such a conduit cleaner which has cutting blades positively attached thereto in such a manner as to facilitate assembly and disassembly of the cutting blade assembly.

2. Background Art

Fluid powered conduit cleaners are well known in the art. An exemplary conduit cleaner is disclosed in U.S. Pat. No. 3,740,785, to Latall. High pressure water delivered to the Latall unit rotates a cutting blade assembly at the leading portion thereof and simultaneously exhausts angularly in a trailing direction through jets so as to impinge upon a conduit wall. This action causes propulsion of the unit and at the same time breaks up foreign matter within the conduit and scours the conduit wall, as to break loose deposits of fat, paraffin, and the like. A skid assembly guides the entire unit in translation against the conduit.

A typical cutting blade assembly has a hub mounted to a rotary shaft and a cutting blade, in the form of a flexible strip, that is wrapped in a substantially circular pattern. The blade is anchored to the hub by directing the free end of the blade radially through the center of the hub. This has generally been recognized as a preferred way of securely holding the blade in place.

The difficulty with the aforesaid arrangement is that the blade anchoring end obstructs the center of the hub so as to prohibit axial passage through the hub of a fastener, as would permit such a fastener to be accessed from the front of the unit. Instead, the hub is elongated to define an axially extending anchoring portion which accepts a fastener that is directed through aligned radial bores in the hub and shaft. This construction has several drawbacks which designers have, to this stage, been unable to overcome.

First of all, if more than one blade is anchored to the hub in the above manner, the penetrated hub becomes inherently weaker, and thus prone to failure.

A more serious problem is that of accessing the fastener/bolt that is used to attach the hub to the shaft. The bolt resides within a narrow space axially between the cutting blade and the motor housing and skid assembly. By lengthening the hub to facilitate access to this mounting bolt, the overall length of the unit is necessarily increased, which is undesirable. At the same time, this lengthening may weaken the hub which again makes it more prone to failure when subjected to normal operating torques.

SUMMARY OF THE INVENTION

The present invention is specifically directed to overcoming the above enumerated problems in a novel and simple manner.

More particularly, a blade assembly is provided for attachment to a shaft that is rotatable about an axis on a conduit cleaner. The blade assembly has a hub defining an axis to be coaxial with the rotational axis of a shaft to which the blade is mounted. A cutting blade is attached to the hub so that the cutting blade does not project through the hub axis.

Accordingly, a fastener for the cutting blade can be directed axially through the hub from the front thereof to secure the cutting blade assembly to a shaft. This avoids having to direct a radially extending bolt through the hub, which requires working in a tight space, as between the cutting blade and a motor that drives the shaft to which the cutting blade assembly is attached.

The hub has a peripheral surface. In one form, the cutting blade is attached to the peripheral surface of the hub. Several of the blades can be attached to the hub in like fashion without weakening the hub.

In one form, the hub has a radially extending wall to be connected to a shaft on a conduit cleaner. A fastener, such as bolt, can be directed through the radially extending wall and threaded into a shaft on a conduit cleaner. An enlarged head on the fastener can capture a washer against the radially extending hub wall.

The invention further contemplates the above structure in combination with a conduit cleaner having a rotary shaft.

To prevent relative rotation between the hub and shaft, a key can be employed so that the connection between the radially extending wall and shaft serves principally to prevent relative axial movement as might occur as when the conduit cleaner is drawn in a trailing direction from a conduit. A radially extending slot can be provided in each of the hub and shaft, with the key projecting into each of the slots.

With the inventive structure, a wide range of cutting blades can be employed. In one form, a plurality of arcuate, flexible blades are used.

The invention further contemplates a blade assembly with a hub, a cutting blade attached to at least one of the hub and a shaft on a conduit cleaner to which the blade assembly is attached, and structure for connecting a forward wall on the hub to a shaft on a conduit cleaner.

DETAILED DESCRIPTION OF THE DRAWINGS

Figure 1:
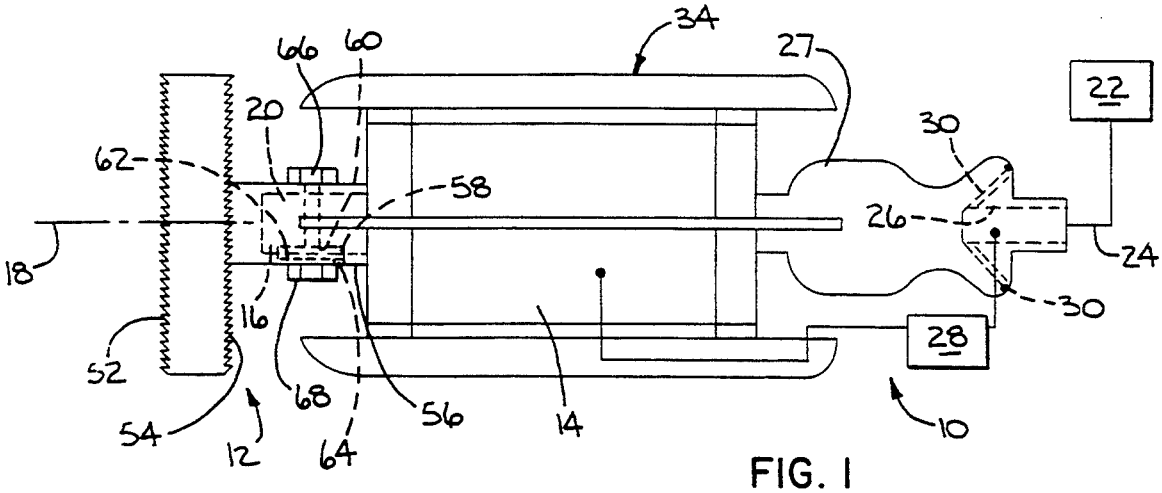
FIG. 1 (PRIOR ART)
FIG. 1 is a side elevation view of a prior art conduit cleaner having a cutting blade assembly at the leading end thereof.
Figure 2:
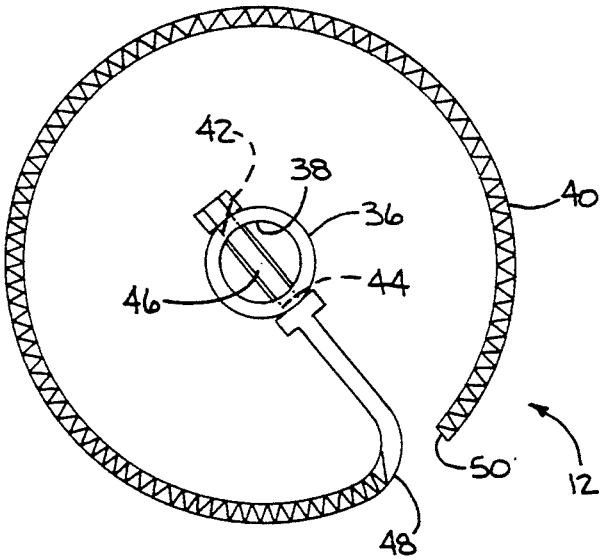
FIG. 2 (PRIOR ART)
FIG. 2 is a front elevation view of the cutting blade assembly on the conduit cleaner of FIG. 1.
Figure 8:
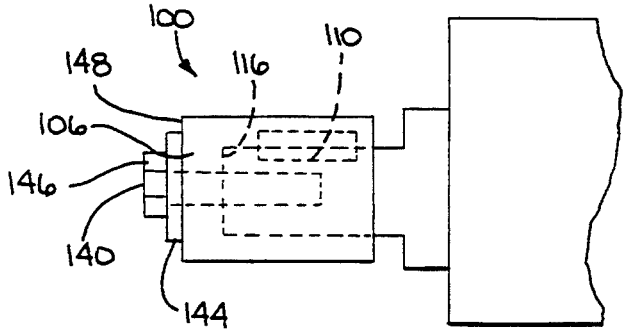
FIG. 8 is an isolated side elevation view of a hub on the inventive cutting blade assembly attached to the shaft on the fluid operated motor of FIG. 4.
Figure 3:
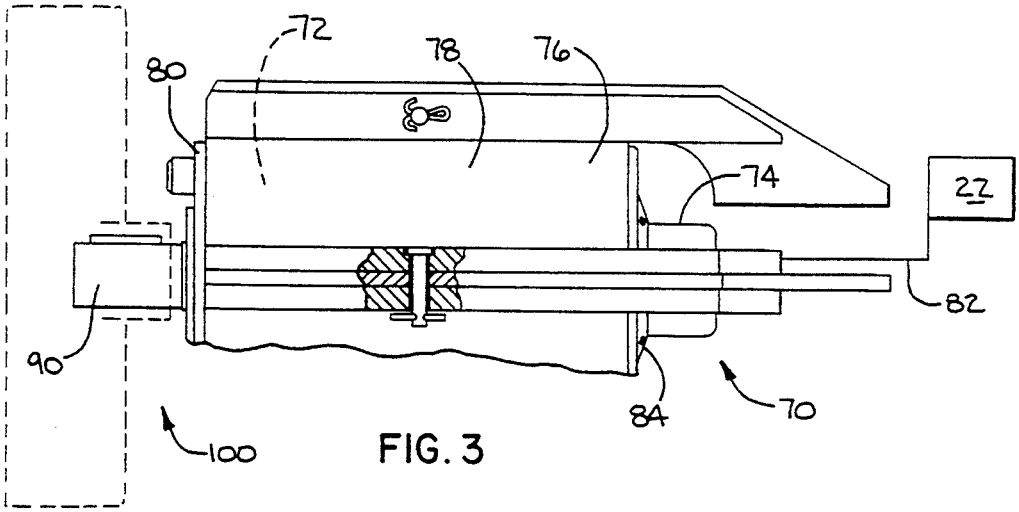
FIG. 3 is a side elevation view of a conduit cleaner with a cutting blade assembly according to the present invention at the leading end thereof.
Figure 4:
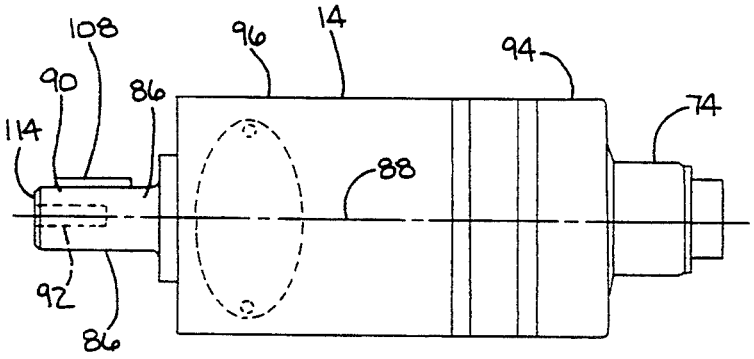
FIG. 4 is an isolated side elevation view of a fluid operated motor used to drive the inventive cutting blade assembly.
Figure 5:
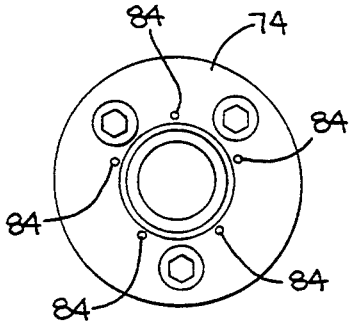
FIG. 5 is a rear elevation view of the motor of FIG. 4.
Figure 6:
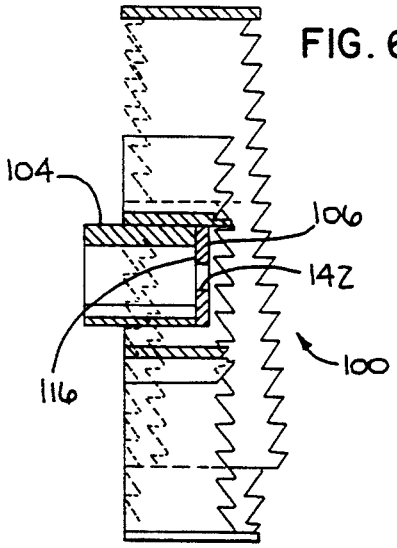
FIG. 6 is a cross-sectional view of the inventive cutting blade.
Figure 7:
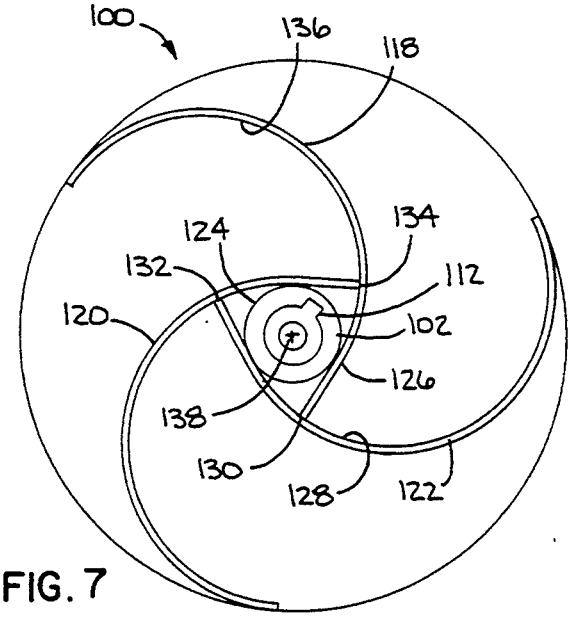
FIG. 7 is a front elevation view of the inventive cutting blade.

In FIGS. 1 and 2, a prior art conduit cleaner is shown at 10 with a conventional cutting blade assembly at 12 mounted at the leading end thereof.

The details of construction and operation of the conduit cleaner are not important to the present invention. Numerous different mechanisms could be used. An exemplary prior art conduit cleaner is shown in U.S.

Pat. No. 3,740,785, to Latall, and described in detail therein. That disclosure is incorporated herein by reference.

Briefly, the prior art conduit cleaner 10 has a motor 14 which drives a rotary shaft 16 about a central axis 18. The exposed forward end 20 of the shaft carries the cutting blade assembly 12, with the cutting blade assembly 12 keyed to the shaft 16 for rotation therewith.

The motor 14 is operated by pressurized fluid from a supply 22, which is delivered through a conduit 24 to a pressure chamber 26 in a nozzle 27 at the trailing end thereof. From the pressure chamber 26, the pressurized fluid is delivered by an appropriate means 28 to the motor 14 for operation thereof. The pressure chamber 26 also communicates with a plurality of jets 30, which direct streams of pressurized fluid radially and in a trailing direction from the nozzle 27.

A skid assembly at 34 guides translatory movement of the conduit cleaner 10 within a conduit.

The cutting blade assembly 12 has a cylindrical, hollow hub 36 with an open forward end 38. The hub 36 serves the dual purpose of supporting a cutting blade 40 and connecting the cutting blade 40 to the shaft 16.

More specifically, the hub 36 has two diametrically opposite openings 42, 44 extending fully therethrough and having a configuration matched substantially to the rectangular cross section of the cutting blade 40. One free end 46 of the cutting blade 40 is directed through both of the bores 42, 44 and suitably fixed to the hub 36, as by welding. The cutting blade 40 extends radially a short distance outwardly from the free end 46, is bent at 48, and from there extends in a substantially circular shape with the outer free end 50 of the cutting blade 40 spaced slightly from the bend 48.

The cutting blade 40 is made from a spring steel and has toothed leading and trailing edges 52, 54 which grind obstructions within a conduit as the conduit cleaner 10 is introduced to and withdrawn from a conduit. The described arrangement of the cutting blade 40 allows flexing of the cutting blade in a radial direction to allow it to biasably engage a conduit wall without binding.

The trailing hub portion 56 fits over the shaft end 20. To prevent relative rotation between the hub 36 and shaft 16, a conventional key 58 can be used and extends radially into a blind slot 60, 62 on each of the shaft 16 and hub 36, respectively. Set screws 64 (one shown) can be threaded through the hub portion 56 and against the key 58 to thereby fix the hub 36 against axial movement relative to the shaft 16.

In an alternative design, the key 58 can be omitted. Instead, a bolt 66 is extended fully through aligned bores in the hub 36 and shaft 16 and is secured by a nut 68.

It can be seen that there is a very limited space between the cutting blade 40 and the skid assembly 34 within which the user can access the bolt 66 and/or set screws 64. Consequently, in the event that the cutting blade assembly 12 is to be removed, for replacement or repair, the operation is delicate and often quite time consuming.

Another problem with the prior art conduit cleaner 10 is that it lends itself to the mounting of only one blade 40. The integrity of the hub 36 would be compromised if an additional cutting blade 40 were added and mounted in like fashion. If multiple cutting blades were to be mounted in axial alignment, the bores 42, 44 would have to be widened, which inherently weakens the hub 36. Alternatively, the cutting blades 40 could be staggered axially, which alters the cutting characteristics and also significantly lengthens the axial dimension for the cutting blade assembly 12. The inventive structure overcomes the above problems, as described with respect to FIGS. 3–8, below.

The inventive conduit cleaner at 70 incorporates several novel features that are the subject of separate patent applications. However, the basic operation of the unit is the same as the prior art conduit cleaner 10, previously described. The conduit cleaner 70 has a motor 72 and a nozzle section 74, which are incorporated into a unit that is housed by a frame 76. The frame 76 includes a cylindrical body 78 and a front wall 80 which defines a cup-shaped receptacle opening in a trailing direction, within which the subassembly, consisting of the motor 72 and nozzle 74, resides. Fluid from the supply 22 communicates via a conduit 82 to the nozzle 74 for driving of the motor 72 and simultaneously discharging fluid from jets 84 in a radially outwardly and trailing direction.

A suitable motor 14 is commercially available through Danfoss Incorporated, in Rockford, Ill. as its OMM 32-151G0033. That motor 14 has a forwardly projecting shaft 86 that is rotatable about a central axis 88. The exposed, leading portion 90 of the shaft 86 has a threaded blind bore 92.

The back cover (not shown) of the motor 14 is removed and replaced by the nozzle 74, which has a peripheral surface 94 that is matched to the diameter of the peripheral surface 96 of the motor 14.

The inventive cutting blade assembly 100 is attached to the free leading end 90 of the shaft 86. The cutting blade assembly 100 includes a central hub 102 having a cylindrical body 104 and a radially extending forward wall 106 secured thereto, as by welding. The hub 102 could, of course, be made as one piece.

The hub 102 closely receives the shaft end 90. To prevent relative rotation between the hub 102 and shaft 86, an elongate key 108 is used. The key resides within a radial undercut 110 in the shaft portion 90 and projects into a receptive undercut 112 in the hub 102.

With the cutting blade assembly 100 in its operative position, the leading surface 114 of the shaft 86 facially abuts the surface 116 of the forward wall 106, which surface 116 faces axially in a trailing direction.

A unique way of connecting, in this case, three cutting blades 118, 120, 122 to the hub 102 allows for facilitated securing of the hub 102 to the shaft portion 90. More particularly, the blades 118, 120, 122 are fixed to the peripheral surface 124 of the hub 102, as seen most clearly in FIG. 7. An exemplary blade 118 has a semicircular shape with one end 126 welded to the hub surface 124. The end 126 extends away from the hub 102 to engage the concave surface 128 on the adjacent cutting blade 122, which is attached to the hub 102 in the same manner as the cutting blade 118. The free edge 130 of the cutting blade 118 can be fixed to the cutting blade 122, as by welding. The other blade 120 is connected to the hub 102 and one free edge 132 of the blade 122 and has a free edge 134 connected to the concave surface 136 of the cutting blade 118. The cutting blades 118, 120, 122 are equidistantly spaced, mutually reinforcing and positively held to the hub 102, without weakening the hub 102.

With this arrangement, the blades 118, 120, 122 do not project into the hub and through the central axis 138 thereof, as in the prior art. Accordingly, a fastener 140, in this case a bolt, can be directed through a bore 142 in the forward wall 106 and directly into the bore 92 in the shaft portion 90 without interference from the blades 118, 120, 122. A washer 144 can be interposed between the enlarged head 146 of the bolt 140 and the leading surface 148 of the hub 102.

The present invention affords the user substantial flexibility in terms of the number and configuration of the cutting blades 118, 120, 122. At the same time, the assembly and disassembly of the cutting blade assembly 100 is facilitated. The user need not work in the close quarters between the cutting blade assembly 100 and the motor 72 to access mounting bolts or set screws. Instead, the bolt 140 at the forward, unobstructed portion of the cutting blade assembly 100 is readily accessed to secure and allow disassembly of the cutting blade assembly 100.

The foregoing disclosure of specific embodiments is intended to be illustrative of the broad concepts comprehended by the invention.

I claim:

1. A blade assembly for attachment to a shaft that is rotatable about an axis on a conduit cleaner, said blade assembly comprising:

a hub defining an axis to be coaxial with the rotational axis on a shaft to which the blade is mounted, said hub having a peripheral outer surface;

first and second cutting blades;

means for attaching the cutting blades to the hub so that the cutting blades do not project through the hub axis, whereby a fastener can be directed axially through the hub to engage a shaft to which the hub is mounted; and means connecting the first and second cutting blades to each other so that the first and second cutting blades reinforce each other.

2. The blade assembly according to claim 1 wherein the cutting blade attaching means attaches the cutting blade to the peripheral surface of the hub.

3. A blade assembly for attachment to a shaft that is rotatable about an axis on a conduit cleaner, said blade assembly comprising:

a hub defining an axis to be coaxial with the rotational axis on a shaft to which the blade is mounted.

said hub having a peripheral outer surface;

a cutting blade; and means for attaching the cutting blades to the hub so that the cutting blades do not project through the hub axis, whereby a fastener can be directed axially through the hub to engage a shaft to which the hub is mounted.

wherein the hub has a radially extending wall and including means for connecting the radially extending hub wall to a shaft on a conduit cleaner to which the hub is connected.

4. The blade assembly according to claim 3 wherein the connecting means comprises a fastener to be directed through the radially extending wall.

5. The blade assembly according to claim 4 wherein the fastener comprises a bolt to be threaded axially into a shaft on a conduit cleaner.

6. The blade assembly according to claim 5 wherein the bolt has an enlarged head and a washer is interposed between the enlarged head of the bolt and the hub.

7. The blade assembly according to claim 1 in combination with a conduit cleaner having a rotary shaft.

8. The blade assembly according to claim 7 including means for keying the hub to the conduit cleaner shaft to prevent relative rotation therebetween with the cutting blade assembly in an operative position on the shaft of the conduit cleaner.

9. The blade assembly according to claim 8 wherein the keying means comprises a drive key, with there being a radially extending slot in each of the hub and shaft of the conduit cleaner into which the drive key projects.

10. The blade assembly according to claim 1 wherein the blades are each at least partially arcuate.

11. A blade assembly for attachment to a shaft that is rotatable about an axis on a conduit cleaner, said blade assembly comprising:

a hub defining an axis to be coaxial with the rotational axis on a shaft to which the blade is mounted, said hub having a forward wall with axially oppositely facing surfaces;

first and second cutting blades;

means for attaching the cutting blades to at least one of the hub and a shaft on a conduit cleaner to which the blade assembly attaches;

means for connecting the forward hub wall to a shaft on a conduit cleaner; and means for connecting the first and second blades to each other at a location spaced radially from the hub so that the first and second cutting blades reinforce each other.

12. A blade assembly for attachment to shaft that is rotatable about an axis on a conduit cleaner, said blade assembly comprising:

a hub defining an axis to be coaxial with the rotational axis of a shaft to which the blade is mounted.

said hub having a forward wall with axially oppositely facing surfaces;

a cutting blade;

means for attaching the cutting blade to at least one of the hub and a shaft on a conduit cleaner to which the blade assembly attaches; and means for connecting the forward hub wall to a shaft on a conduit cleaner, wherein the connecting means comprises a fastener extending through the forward hub wall to extend into a shaft on a conduit cleaner.

13. The blade assembly according to claim 12 in combination with a conduit cleaner having a rotary shaft.

14. The blade assembly according to claim 13 wherein the fastener comprises a threaded member which is received in a threaded bore in the shaft on the conduit cleaner.

15. The blade assembly according to claim 13 wherein the shaft on the conduit cleaner has an axially facing free end and the forward hub wall abuts to the free end of the conduit cleaner shaft with the blade assembly in an operative position on the conduit cleaner.

16. The blade assembly according to claim 15 wherein the fastener has an enlarged head and with the blade assembly in its operative position the forward hub wall is captive between the enlarged head and the free end of the shaft.

17. The blade assembly according to claim 13 including means for keying the hub to the conduit cleaner shaft to prevent relative rotation therebetween with the cutting blade assembly in an operative position on the shaft of the conduit cleaner.

18. The blade assembly according to claim 13 wherein the keying means comprises a drive key, with there being a radially extending slot in each of the hub and shaft of the conduit cleaner into which the drive key projects.

19. The blade assembly according to claim 13 including a second cutting blade and means for attaching the second blade to the hub so that the second cutting blade does not project through the hub axis.

* * * * *